United States Patent [19]

Renner

[11] Patent Number: 4,657,254

[45] Date of Patent: Apr. 14, 1987

[54] PARLOR GAME APPARATUS FOR PLAYING A SIMULATED SKILL GAME INVOLVING MULTIPLE CHOICE STRATEGY

[76] Inventor: David B. Renner, Rte. 4, Box 207, Victoria Rd., DeSoto, Mo. 63020

[21] Appl. No.: 749,012

[22] Filed: Jun. 26, 1985

[51] Int. Cl.[4] ..... A63F 3/00

[52] U.S. Cl. ..... 273/88; 273/93 R; 273/244; 273/258; 273/259

[58] Field of Search ..... 273/93 R, 93 C, 88, 273/94, 85, 87 R, 244–249, 258, 259, 277

[56] References Cited

U.S. PATENT DOCUMENTS

| | | | |
|---|---|---|---|
| 890,890 | 6/1908 | Dapping | 273/93 R |
| 957,872 | 5/1910 | Ely | 273/93 C |
| 1,661,723 | 3/1928 | Helfgott | 273/259 |
| 2,528,029 | 10/1950 | Brown | 273/93 R |
| 3,693,977 | 9/1972 | de Keller | 273/248 |
| 4,000,897 | 1/1977 | York | 273/93 R X |
| 4,355,812 | 10/1982 | McCullough | 273/248 |

FOREIGN PATENT DOCUMENTS

| | | | |
|---|---|---|---|
| 5114 | 10/1905 | France | 273/248 |

*Primary Examiner*—Paul E. Shapiro
*Attorney, Agent, or Firm*—Haverstock, Garrett and Roberts

[57] ABSTRACT

A board game apparatus for playing a simulated skill game involving at least two players. A first game portion displays the progress of play of the simulated skill game and a second game portion a multiple choice strategy game which affects and determines in part the progress of play of the simulated skill game. The second game portion includes a playing board, and first and second groups of playing pieces, designations on the playing board indicating positions suitable for being occupied by the playing pieces, indicia associated with certain ones of the designations identifying plays of the simulated skill game, and game motivators usable by the players in alternating turns to produce movement indications. The positioning of the first and second groups of playing pieces relative to the designations at the beginning of each player's turn in combination with the movement indication produced by each player through use of the game motivators determines available play options in a particular turn. Selection of one of the available play options by one of the players in a particular turn determines the movement and positioning of the playing pieces controlled by such player. The positioning of the playing pieces of each player at the conclusion of each of the turns determines the particular indicia which affects the play of the simulated skill game in each turn, such particular indicia in combination with the status of the simulated skill game determining the play of the simulated skill game in such turn.

15 Claims, 16 Drawing Figures

| OFFENSIVE MOVE | Scoring Notes | DEFENSIVE MOVE | Two landing on opponents uncovered | DOUBLES (Errors) | Scoring Notes |
|---|---|---|---|---|---|
| Bunt | • Infield Hit<br>• Baserunners advance one base | • Ground out<br>• One baserunner advances | • Strike out | • Infield error (E1 or E3) | • Batter safe at first<br>• Baserunners advance one base |
| SB (Stolen Base) | • Advance lowest baserunner one base | • Lowest baserunner is out stealing | • Defense choice of baserunner out stealing | • Infield Error (WP or E2) | • Baserunners advance one base |
| DP (Double Play) Defensive Score Only | • Batter and lowest baserunner are both out | • Batter and choice of baserunner are both out | • Choice of batter and/or baserunners for outs | • Infield error (E6 or E4) | • Batter safe at first on fielding error<br>• Baserunners advance two bases |
| Sac (Sacrifice) | • Batter out but lead baserunner advances one base | • Ground out<br>• No baserunners advance | • Strike out | • Infield error (E6, E5, or E4) | • Batter safe at first on throwing error<br>• Baserunners advance one base |
| W (Walk) | • Batter advances to first<br>• Baserunners advance one base if forced | • Strike out | • Strike out | • Infield error (WP) | • Hit batter goes to first base<br>• No baserunners advance unless forced |
| HR (Home Run) | • Batter circles bases<br>• All baserunners score | • Fly out to left field (FO7) | • Fly out to right field (FO9) | • (Home Run) | • Batter circles bases<br>• All baserunners score |
| ● (Single) | • Batter advances to first base<br>• Baserunners advance one base | • Ground out | • Ground out | • Infield error (E5 or E3) | • Batter safe at first<br>• All baserunners advance one base |
| ●● (Double) | • Batter advances to second base<br>• Baserunners advance two bases | • Fly out to center field (FO8) | • Fly out to right field (FO9) | • Outfield error (E8 or E9) | • Batter advances to second base<br>• Baserunners advance two bases |
| ●●● (Triple) | • Batter advances to third base<br>• All baserunners score | • Fly out to center field (FO8) | • Fly out to left field (FO7) | • Outfield error (E7 or E8) | • Batter advances to third base<br>• All baserunners score |

Fig. 3

PARLOR GAME APPARATUS FOR PLAYING A SIMULATED SKILL GAME INVOLVING MULTIPLE CHOICE STRATEGY

BACKGROUND OF THE INVENTION

1. Field of the Invention

The present invention relates to a game apparatus wherein the play of a simulated skill game, such as a competitive sports game, is controlled and determined by the play of a multiple choice strategy parlor game, the play of which is dependent upon chance elements which limit available play options and is also dependent upon a player's judgment in tne selection of one of the available play options.

2. Brief Description of the Prior Art

It is known in the art to provide a game apparatus for the play of a simulated skill game, such as baseball or football, wherein the play of the simulated skill game is determined and controlled, either solely or primarily, by chance elements, such as dice, or by statistical elements. Because the outcomes of such games are determined solely or primarily by chance elements or statistical elements, such prior art game apparatuses lack a certain amount of realism and provide, at best, only a limited challenge to the judgment skills of a player.

It is also known in the art to provide a game apparatus for the play of a game involving multiple choice strategy wherein one of a plurality of possible movements is selected by a player to directly affect the play of the game. Such games include checkers and chess. It is also known in the art to provide a game apparatus for the play of a game wherein the total number of available options in a given turn is reduced by way of chance means, such as dice, so that a player's strategy in selecting an option during one turn will differ during each subsequent turn because the available options will be substantially different. It is also known in the art to provide a game apparatus which includes a plurality of playing pieces to move about to certain positions whereby only certain arrangements of the playing pieces on designated positions affect the play of the game. A game utilizing chance elements to control the available options in a game involving multiple choice strategy and utilizing a plurality of playing pieces to move about to certain positions is backgammon. The combination of the above-mentioned elements into a single game, such as backgammon, provides a relatively high level and degree of multiple choice strategy. However, the object of backgammon is for one player to remove all of the playing pieces controlled by him from the playing board before an opponent player can remove all of his playing pieces from the playing board so that movement of the playing pieces is directed to that end.

The game apparatus of the present invention combines the excitement of a simulated skill game, such as a competitive sports game, with multiple choice strategy principles and chance elements to produce a more realistic simulated skill game which is exciting and exhilarating and also tests and challenges the judgment skills of the participants.

SUMMARY OF THE INVENTION

The game apparatus of the present invention includes a first game portion having means for displaying the progress of play of a simulated skill game, such as a competitive sports game, and a second game portion having first and second groups of playing pieces, each group being controlled by a different player, a playing board having designations thereon indicating positions which are capable of being occupied by the playing pieces, selected ones of the designations having indicia associated therewith identifying offensive and defensive plays of the simulated skill game, and game motivators, such as dice, cards or a spinner that provide an element of chance.

As utilized herein, the term "offensive play" refers to a play wherein a player receives points, runs, etc. that benefit such player in achieving the object of the particular simulated skill game. The term "defensive play", as utilized herein, refers to a play wherein a player scores outs, downs, blocked points, etc. to the detriment of the opposing player.

The play of the simulated skill game is primarily determined and controlled by the indicia associated with the designated positions. The indicia on each designated position corresponds to one offensive and/or one defensive play and the choice of moving a playing piece or a plurality of playing pieces to a particular designated position is based on the outcome that is desired in the play of the simulated skill game.

For a particular turn, tne options which are available to affect the outcome of the simulated skill game are dependent upon tne game motivators in combination with the positioning of the groups of playing pieces at the beginning of a player's turn. In addition, the number of options which are available on a particular turn to affect the outcome of the simulated skill game can be made dependent upon specific arrangements of the playing pieces relative to the indicia associated witn the designated positions.

Selection by a player of one of the available options determines the positioning of the playing pieces at the conclusion of such player's turn. The positioning of the playing pieces at the conclusion of each player's turn, in combination with the status of the simulated skill game, determines the particular indicia which affects the play of the simulated skill game for each turn.

Therefore, a principal object of the present invention is to provide a game apparatus for the play of a simulated skill game, the outcome of which is controlled and determined by the play of a multiple choice strategy game.

Another object of the present invention is to teach the use of a game apparatus for playing a simulated skill game which embodies a relatively high level of multiple choice strategy.

Another object of the present invention is to provide a game playing apparatus which is entertaining, exhilerating, and fun to play, as well as one which tests the judgment skills of the participants.

Another object of the present invention is to provide a game apparatus whicn can be used to stimulate competition between the participants and which can also test and improve the relative mental skills of the participants.

Another object of the present invention is to provide a game apparatus which is relatively inexpensive and easy to manufacture.

Another object of the present invention is to teach the construction and operation of a relatively versatile and inexpensive yet challenging and realistic game that can be played and enjoyed by persons of all ages.

These and other objects and advantages of the present invention will become apparent after considering the following detailed specification in conjunction with the accompanying drawings.

BRIEF DESCRIPTION OF THE DRAWINGS

FIG. 3 is a table relating certain indicia on tne playing surface of the game playing board to offensive and defensive plays of the sports game of the preferred embodiment and showing how the positions of certain playing pieces relative to such indicia at the conclusion of a player's turn may be utilized to determine the simulated play of the sports game.

DESCRIPTION OF A PREFERRED EMBODIMENT

Figure 1:
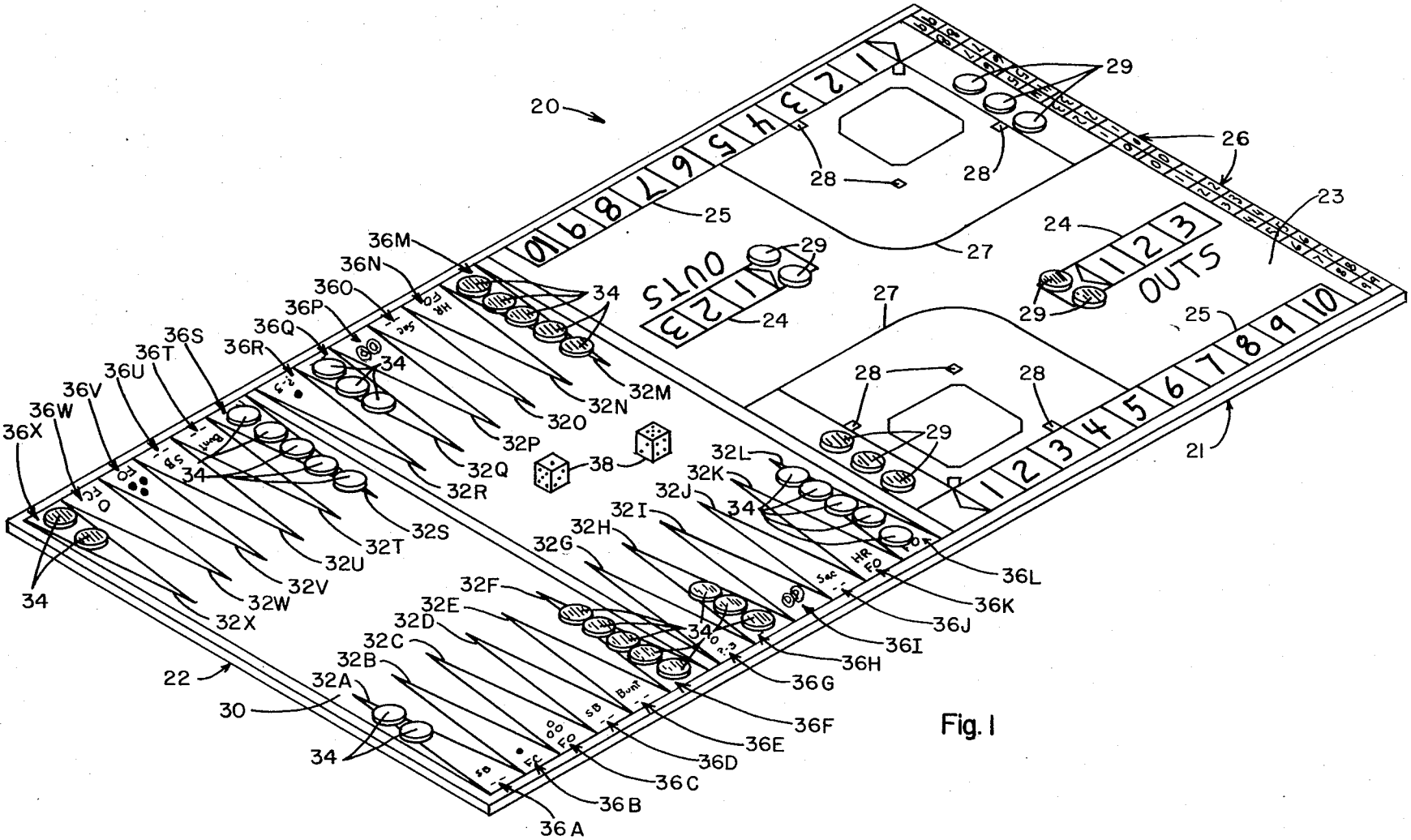
FIG. 1 is a perspective view of one preferred sports game embodiment of the present invention, shown with the game apparatus including playing pieces positioned for the beginning of play and means for displaying the progress of play of the sports game.

Referring to the drawings more particularly by reference numbers, wherein like numbers refer to like parts, the number 20 of FIG. 1 identifies a preferred simulated skill game embodiment, in this instance, a baseball game embodiment, constructed according to the teachings of the present invention, which embodiment includes a first game portion 21 and a second game portion 22. In the depicted embodiment, the first game portion 21 includes a game board portion 23 for displaying the progress of play of a simulated baseball game, wherein the game outcome is determined by the offensive and defensive plays of the respective players during tne course of the game. Tne baseball game board portion 23 includes various indicia thereon pertaining to various aspects of baseball, wnicn indicia include markings 24 reflecting each player's number of outs in an inning, markings 25 reflecting the number of innings offensively played by each player, markings 26 reflecting the total number of runs scored in the game by each player, and markings 27 indicating a playing field for each player and having bases 28 indicated thereon.

Playing pieces 29 are provided to be moved about the playing board portion 23 during game play and, more particularly, to be moved about the markings 24 to reflect the correct number of outs, to be moved about the markings 26 to reflect the correct number of runs scored by each player, and to be moved about the markings 27 along the bases 28 to reflect the positions of each player's baserunners. Other playing pieces which, as will be explained hereinafter, are employed with the second game portion, are used with the markings 25 to reflect the correct number of offensive innings completed by each player. It should be noted that the playing pieces 29 can be provided in a variety of colors to allow the players to easily distinguish and identify those ones of the playing pieces 29 controlled by each of the different players.

It will be appreciated by those of ordinary skill in the art that, while the playing board portion 23 provides a means for displaying the progress of the competitive sports game, namely, baseball, other means could also be provided and utilized to accomplish the same purpose. For example, although the play of the game would be less readily visible to observers, a scorecard could be readily utilized to reflect the number of outs, the number of innings played by each player, the advancement of baserunners along the basepaths and the score of the game.

In addition, it will be appreciated by those of ordinary skill in the art that the simulated skill game may be a game other than baseball. For example, the game may be football, soccer, boxing, or hockey, or any other simulated skill game, including other competitive sports games involving offensive and defensive plays or moves, and the progress of play thereof may be displayed on a playing board having the proper indicia thereon and by moving playing pieces thereon, or the progress of play may be displayed oy other means such as by a scorecard.

The play of the simulated skill game is controlled and determined by the play of a multiple choice strategy game associated with the second game portion 22. In the preferred embodiment, the game associated with the second game portion 22 is a backgammon-type game. The second game portion 22 includes a playing board portion 30 having designations or points 32A–32X disposed thereon generally indicating positions that are capable of being occupied by playing pieces 34. The playing pieces 34 are divided into two groups of equal number, one group of the playing pieces 34 to be controlled by one player or a single group of players and the other group to be controlled by an opponent player or a single group of opponent players. The number of designations may vary, but it has been found advantageous to use the same number as is used in a typical backgammon-type game, i.e., 24, in order to facilitate the incorporation of backgammon rules. For the same reason, although the playing pieces 34 may vary in number, it is preferred that the total number used be the same as the total number of pieces used in the typical backgammon game, i.e., 30. The playing pieces 34 may be provided in a variety of colors to distinguish and identify those ones of the playing pieces controlled by each of the different players. It will be readily understood by those of ordinary skill in the art that other multiple choice strategy games may also be associated with the second game portion 22 and utilized to affect the play of the competitive sports game.

Each of the designations 32A–32X has indicia 36A–36X associated therewith, each of which indicia, in the preferred embodiment, identify an offensive and/or defensive play in the baseball game. For example, in the preferred embodiment, the indicia 36K associated with designation 32K includes markings identifying a home run as an offensive play and a fly-out as a defensive play, the manner of attainment of which plays and the effect of which plays on the play of the baseball game will be discussed and described more fully hereinafter.

The versatility of the game apparatus of the present invention is characterized by the fact that the indicia can be constructed to be removable or replaceable so that if it is desired to change from one competitive sports game to another, or if it is desired to change the combinations of offensive and defensive plays, the change can easily be made by removing one set of indicia and disposing another set of indicia on selected ones of the designations 32A–32X. However, where the versatility aspect is not desired, indicia 36A–36X may be disposed on selected ones of the designations 32A–32X in a permanent manner, such as by gluing or printing directly tnereon.

The movement of the playing pieces 34 is controlled, in part, by game motivators or chance elements which, in the preferred embodiment, are conventional dice members 38. Other game motivators such as cards and spinners can also be used and these will also provide elements of chance. The game motivators are utilized to identify one or more play possibilities or to limit the number of play possibilities available for selection by a player during each particular turn. Each of the play possibilities affect the play of the simulated skill game, with selection of one of the available play possibilities determining the play of the simulated skill game, as will be discussed hereinafter. Thus, the play of the second game portion is dependent upon chance elements in combination with the judgment skills of the players.

Tne object of the particular game described above, namely, baseball, is to outscore the opponent, and a preferred, basic method of play utilizing such game apparatus will be described in that which follows. For convenience of explanation it is assumed that there are two players each controlling the movement of a group of twenty (20) playing pieces, five (5) of the playing pieces relating to the game playing pieces 29 of the first game portion for displaying the progress of play of the simulated skill game and fifteen (15) of the playing pieces relating to the game playing pieces 34 of the second game portion. The fifteen (15) of the playing pieces 34 are distributed on the designations 32 by each player in the manner of a typical backgammon game, as shown in FIG. 1, wherein one player distributes two (2) of the playing pieces 34 on designation 32A, five (5) of the playing pieces 34 on 32L, three (3) on 32Q and five (5) on 32S, this particular player being here referred to as the "visiting team" player. Tne other player, being here referred to as the "home team" player, distributes two (2) of the playing pieces 34 on designation 32X, five (5) on 32M, three (3) on 32H and five (5) on 32F. With such positioning, the "home team" player will move the playing pieces 34 controlled by him in a clockwise direction toward designations 32–32F, which designations are bearing off points for tne home team and are referred to collectively as home's inner table, and the "visiting team" player will move the playing pieces controlled by him in a counter-clockwise direction toward designations 32S–32X, which designations are bearing off points for the visitor team and are referred to collectively as visitor's inner table. Various means can be utilized to determine which one of the players is the "home team" player. For example, each player can roll one of the dice members 38 with the player that rolls the highest number being allowed to choose.

Play is started by the "visiting team" player rolling or casting the dice members 38. The number combination resulting on the upsides of the dice members 38 determines the number of the designations 32 that the player may move one or more of the playing pieces 34 controlled by such player, as is generally the case in a typical backgammon game. For example, if the "visiting team" player rolls the dice members 38 and the upside of one of the dice members 38 displays a six (6) and the upside of the other of the dice members 38 displays a four (4), the player may move one of the playing pieces 34 controlled by him to one of the designations 32 that is six positions removed from the original one of the designations 32 in a counter-clockwise direction, and another one of the playing pieces 34 controlled by him to one of the designations 32 that is four positions removed from the original one of the designations 32 in the same direction. Alternatively, the player may move one of the playing pieces 34 controlled by him a total of ten positions removed from the original one of the designations 32 in a counter-clockwise direction. If a player rolls doubles, i.e., if the upsides of both of the dice members 38 reflect the same number, movement of playing pieces 34 is effected as if the player had rolled four dice, the upsides of each of which reflect such same number, and the player may tnerefore move from one up to four of the playing pieces 34 in a manner similar to that described above.

As is true of backgammon plays, a player cannot move a playing piece to a designation or point that has two or more of the opponent's playing pieces thereon. Such a designation is considered to be "blocked" to the opponent and "protected" by the player whose playing pieces are disposed thereon. However, a playing piece may be moved past such a designation, and may be moved to a designation or point that has only one of the opponent's playing pieces thereon or to a designation or point that is empty or has only such player's own playing pieces thereon. These designations are all considered to be "unblocked". A playing piece which is the only playing piece on a particular designation or point is an "uncovered" playing piece and is subject to being covered by any other playing piece 34.

It will be recognized by those skilled in the art, and especially by those familiar with the play of backgammon, that, depending upon the roll of the dice members 38, a player will generally be entitled to select a play from among a variety of available play movements. In some instances, however, depending upon the positioning of the playing pieces 34 and the roll of the dice members, a player may have only a single, or in a few instances, no, possible plays. For any roll of the dice, the selection of a particular play from among the available play movements will result in the repositioning of the playing pieces 34 on game board portion 30, and the position of such playing pieces relative to the designations 32A–32X and the indicia 36A–36X associated therewith at the conclusion of a player's play may (but need not necessarily) effect certain offensive and/or defensive plays on behalf of such player in the baseball game, as will be hereinafter discussed.

After the "visiting team" player has completed the movement of the playing pieces 34 and determined the effect of tne positioning of such playing pieces upon the baseball game, such player may then position appropriate of his playing pieces 29 on the baseball playing board 23 to reflect the effected offensive and defensive plays and to display the progress of the simulated baseball game. Once the positioning of such playing pieces has been completed, the "visiting team" player's turn comes to an end and the "home team" player may take his turn.

The indicia 36A–36X identify various offensive and defensive plays of a baseball game, and a particular player can obtain the benefit thereof in the simulated baseball game upon certain arrangements of the playing pieces 34 relative to the designations 32A–32X. The indicia 36A–36X, the offensive and defensive plays that are identified thereby, and the particular arrangements of the playing pieces that obtain the benefits of the plays are denoted in the table of FIG. 3. In general, a player obtains the benefit of an offensive play when, in his turn, he lands one or more of his playing pieces on any unblocked, unprotected designation or point such that two or more of his playing pieces remain on such designation or point at the end of his play. A player obtains the benefit of a defensive play against his opponent when, in his turn, he lands one or more of his playing pieces upon an uncovered playing piece of his opponent or when, in a single turn, he lands two or more of his playing pieces on an unblocked, unprotected designation or point.

Figure 4:
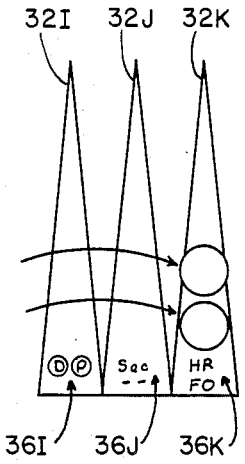
FIGS. 4–13 illustrate various possible moves in the multiple choice strategy game portion of the preferred embodiment.
Figure 5:
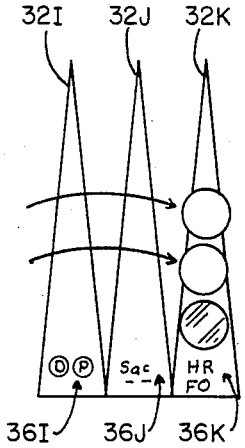
Figure 6:
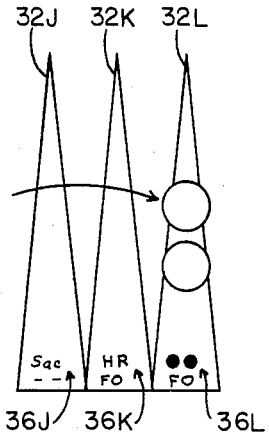
Figure 7:
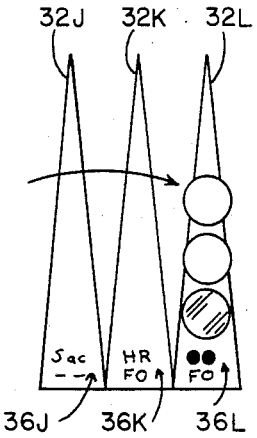
Figure 8:
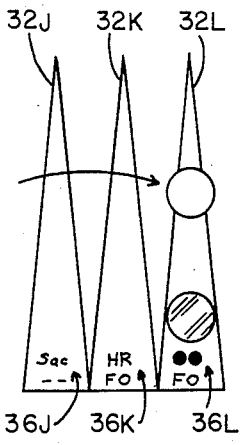

Thus, FIGS. 4–7 illustrate moves that would result in the visiting team player receiving the benefit of an offensive play, and FIGS. 4–8 illustrate moves that would result in the visiting team player receiving the benefit of a defensive play against the visiting team player. In all of FIGS. 4–7 the move of the visiting team player has resulted in an arrangement of the playing pieces such that, at the conclusion of the visiting team player's move, at least two of the visiting team player's playing pieces have been landed on an unblocked, previously unprotected designation. In FIGS. 5, 7, and 8 the move of the visiting team player has resulted in an arrangement of the playing pieces such that, at the conclusion of the visiting team player's move, at least one of the visiting team player's playing pieces has been landed on an opponent's uncovered playing piece. In FIG. 4 the move of the visiting team player has resulted in the landing of at least two of such player's playing pieces upon an unblocked, previously unprotected designation or point in a single turn.

As a result of tne move depicted in FIG. 4 the visiting team player thus benefits both offensively and defensively. He receives the benefit, offensively, of a home run and, defensively, of a putout in the form of a fly-out by the home team player. The same applies with respect to the move depicted in FIG. 5.

As a result of the move depicted in FIG. 6 the visiting team player benefits offensively and defensively. He receives the defensive benefit of a putout in the form of a fly-out by the home team player and he receives an offensive benefit in the form of a double associated with designation 32L. The move depicted in FIG. 7 would also entitle the visiting team player to both the offensive and defensive benefits, while the move depicted in FIG. 8 would result in only a defensive benefit, with no offensive benefits, to the visiting team player.

Figure 9:
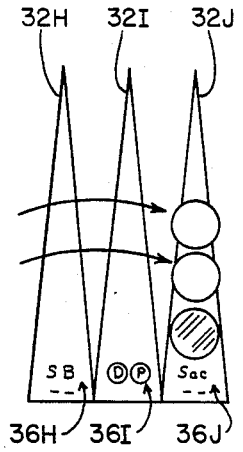
Figure 10:
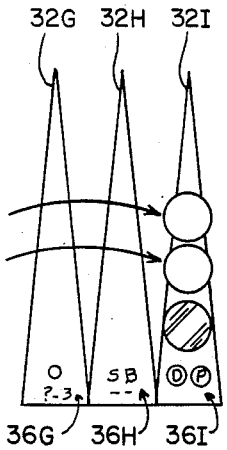

The table of FIG. 3 indicates that, in instances where doubles are thrown, the scoring of the offensive play may be changed if a player, in his turn, lands two or more of his playing pieces upon an opponent's uncovered playing piece. In such event, except for the scoring of an offensive home run, the opponent is charged with an error. By way of illustration, for the move depicted in FIG. 5 the visiting team player would be offensively accorded a home run, regardless of whetner or not doubles had been thrown. However, if the move depicted in FIG. 9 is made by the visiting team player upon his throw of doubles, such player, instead of being accorded an offensive sacrifice where the batter is out and the lead baserunner (if any) advances one base, is treated as the beneficiary of an infield error by his opponent, with the visiting team batter being safe at first on the error and all baserunners advancing one base. Such player also receives, defensively, the benefit of a strikeout by the home team player. Similarly, if the move depicted in FIG. 10 is made by the visiting team player upon his throw of doubles, such player, instead of being charged with a double play for his offensive play, is treated as the beneficiary of an infield error by his opponent, with the visiting team batter being safe at first on the error and all baserunners advancing two bases. Such player also receives, defensively, the benefit of up to a double play against the home team player, with the visiting team player having the option of choosing the batter and/or baserunner(s) (if any) of the home team player that will be designated as being out.

Figure 11:
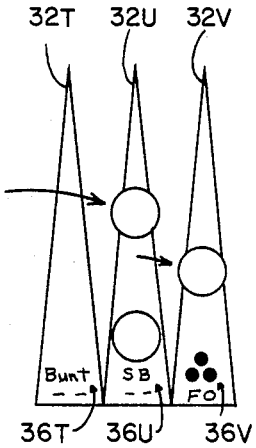
Figure 12:
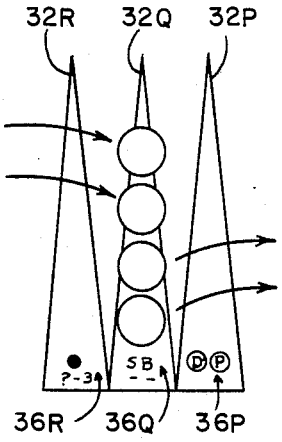
Figure 13:
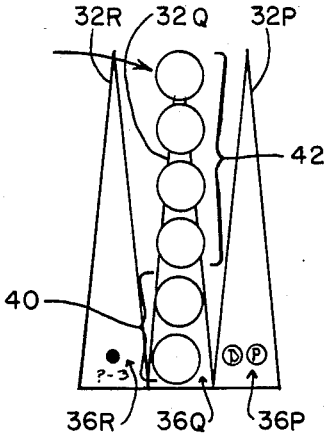

From what has already been discussed hereinbefore, it will be appreciated that a player cannot, in single turn where he has not thrown doubles, move one of his playing pieces off a protected designation and move another playing piece back onto such designation, as depicted in FIG. 11, to obtain the benefit of the offensive/defensive plays associated with such designation. However, since doubles are treated as, in effect, two throws of the dice members 38, a player may, in such doubles turn, move two or fewer playing pieces from a particular designation and two or more playing pieces back onto such designation, as depicted in FIG. 12, and obtain the benefit of the offensive/defensive plays associated with such designation. In no event will the stacking of more than two playing pieces upon any designation accord the player making such stacking moves the benefit of the offensive/defensive plays associated with such designation. Only the initial two playing pieces of a player upon any designation may be utilized by him for obtaining the benefit of the offensive/defensive plays associated with that designation. It will thus be appreciated that, in FIG. 13, only the playing pieces 40 score, while the stacked playing pieces 42 do not score.

From the foregoing, it will be appreciated that not all moves made by a player will necessarily result in either an offensive or a defensive play. For example, the movement of a single playing piece onto a empty or already protected designation will not result in any baseball play. It is also possible that, in some instances, a player may be unable to make a move. Such a circumstance could arise if the only movements possible in accordance with the number combination determined by a throw of the dice members 38 would be to blocked designations.

Although the play of the backgammon-type game portion of the preferred embodiment of the present invention, and the movement of the playing pieces thereof, have heretofore been described in such a manner as to show the similarities between such game portion and a standard backgammon game, it is now necessary to point out a distinction therebetween. In the typical backgammon game, when one player lands a playing piece on an uncovered playing piece of his opponent, the opponent's uncovered playing piece is said to be "hit" and is thereupon removed from the designation and placed "on the bar", from which position such playing piece must be restarted before the opponent can move any other of his playing pieces. In the preferred embodiment of the present invention, an uncovered playing piece which is "hit" is not removed from the designation upon which it rests, but is allowed to remain there. Such playing piece must thereafter be moved to another designation before any other of that player's playing pieces can be moved, however.

Figure 2:
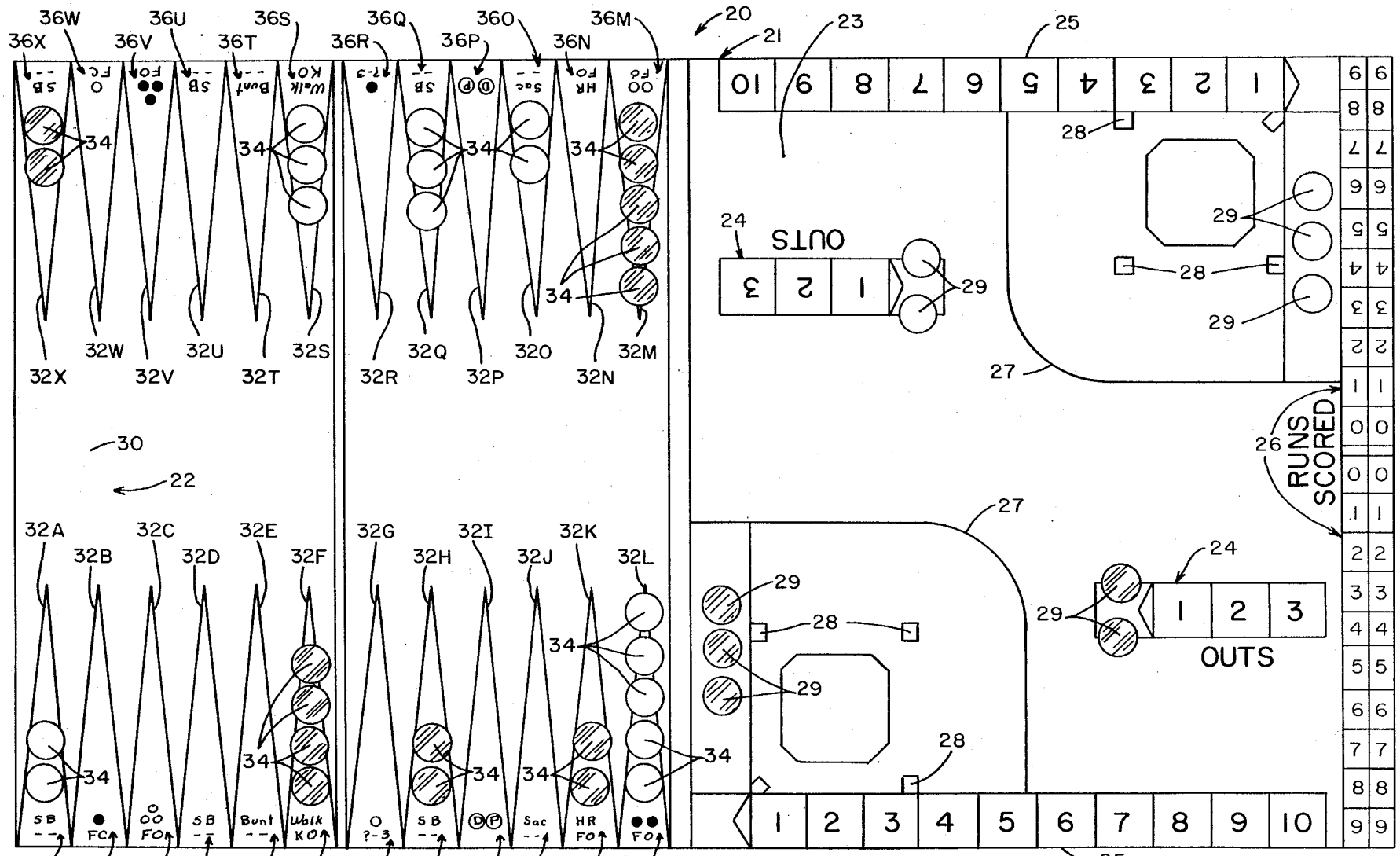
FIG. 2 is a top plan view of the game playing board of the emoodiment of FIG. 1 more clearly snowing the indicia appearing at tne designated positions on the game playing board.

Before proceeding with a further discussion of the play of the simulated baseball game of the preferred embodiment, it should be noted that the various offensive/defensive play combinations associated with the designations 32A–32X could be altered to increase or decrease the level and degree of multiple choice strategy as desired. It has been found, however, that the particular combinations utilized in FIGS. 1 and 2 and shown in FIG. 3 are well suited for a game that can be played and enjoyed by persons of all ages.

From the foregoing, it will be understood that as each player takes a turn, such player scores hits and runs to his own benefit and scores outs against his opponent. An offensive inning for a player is completed whenever three outs are recorded against him. At the conclusion of each inning, the player removes all of his playing pieces 29 that have been placed on markings 28 indicating his team's baserunners. In addition, such player removes one of the playing pieces 34 controlled by him from the playing board 30 and places that playing piece 34 on the appropriate markings 25 to indicate the completion of another of his offensive innings of play and to display the total number of offensive innings that have been played by him. If the third out is scored against a player by or as a result of a "hit" of one of his playing pieces 34, then the particular playing piece that was "hit" is removed. If the out is scored against such player by the opponent moving one or a plurality of playing pieces 34 to an unoccupied one of the designations 32, or as a result of an offensive play by such player that results in a third out, such as an offensive sacrifice when there are already two outs, then the player removes one of the playing pieces 34 that is furthest removed from the bearing off points of his inner table.

If nine offensive innings of play are completed for one player before the other player, the player whose offensive innings have been completed can no longer receive the benefit of an offensive play. However, he continues to take his turn and receives the benefit of defensive plays to which he may be entitled in order to score outs against the other player and to force the game to completion. It will be readily understood that the other player will no longer receive any benefit from defensive plays, but will be entitled to receive the benefit of all offensive plays.

The players alternate turns and continue moving the playing pieces 34 around the playing board 30 in their respective directions in the manner hereinbefore described until nine innings of offensive play have been completed by both players or until, as in backgammon, all of the playing pieces 34 controlled by one player are positioned in such player's inner table. Generally, nine innings of play cannot be completed before all of the playing pieces 34 controlled by one player are positioned in such player's inner table. The player then begins, on each of such player's subsequent turns, to remove selected ones of the playing pieces 34 from the board 30 in the same manner as if he were "bearing off" tokens in backgammon. For each roll of the dice members 38 in a particular turn, the player may remove a playing piece 34 that is positioned on a designation 32 that corresponds to a number reflected on the upside of a dice member, or the player may elect to move one or more of his playing pieces 34 from one of the designations 32 to one of the designations 32 which is lower in number for scoring purposes. Alternatively, the player may remove a playing piece which is positioned on a designation that is lower in number than a number reflected on the upside of a dice member, but, such player may so remove the playing piece only if tnere are no other playing pieces 34 on the designation 32 which corresponds to the number reflected on the upside of the dice member and there are none of the playing pieces 34 positioned on a designation which is higher in number. If the player does not have playing pieces 34 on designations 32 corresponding in number to the numbers reflected on the upsides of the dice members 38, but, the player has one or more of the playing pieces 34 positioned on a designation which is higher in number, then he must move the playing pieces 34 in the normal manner to designations 32 that are lower in order in his inner table.

Although, in the preferred embodiment, a player does not have to remove any of the playing pieces 34 from the playing board 30, as described above, in any given turn, it is to such player's benefit to remove as many of the playing pieces 34 as possible in any one turn because such player can receive the benefits of various bonuses for successfully and rapidly bearing his playing pieces off. For every two of the playing pieces 34 that such player removes from the playing board 30 in a particular turn, such player may choose one defensive play associated with a designation 32 located within the opponent's inner table which has positioned thereon an opponent's uncovered playing piece. If the opponent has more than one uncovered playing piece within his inner table, the player who has borne off may choose a defensive play associated with any of the designations that has an opponent's uncovered playing piece tnereon. If the opponent has no uncovered playing pieces remaining, the player who nas borne off the two playing pieces 34 does not receive the benefit of a defensive play. If a player has rolled doubles, and as a result thereof has removed four of his playing pieces, he is entitled to up to two defensive plays. In addition, once a player has removed all of his playing pieces 34, each remaining playing piece of the opponent on the playing board 30 will be scored as a strike against such opponent, and every three strikes will result in an out that is recorded against the opponent.

Once a player has removed all of his playing pieces, game board portion 30 is cleared of all remaining playing pieces and reset. Since each player has removed one of his playing pieces 34 for each offensive inning of play completed, each player has less than his original fifteen (15) playing pieces. Each player distributes his remaining ones of the playing pieces 34 on the designations 32, beginning with the designations farthest from the bearing off designations of their respective inner tables. Thus, the "visiting team" player begins by distributing two (2) of his playing pieces 34 on designation 32A, five (5) on 32L, and so on, as described hereinbefore, until he has distributed all of his playing pieces 34 that remain. The "home team" player begins by distributing two (2) of his remaining pieces on 32X, five (5) on 32M and so on, as described hereinbefore, until all of playing pieces 34 that remain have been distributed. The player who was first to remove all of his playing pieces 34 is the player that will move first once the game has been reset. It should be noted that the game does not end when one of the players has removed all of his playing pieces 34. Rather, the game ends only after the completion of nine (9) offensive innings by both players, unless the score is tied at the end thereof.

As hereinbefore described, the players alternate turns until nine complete innings have been played. If the score is tied at the end of nine (9) full innings of play, the game goes into extra innings. If extra innings are required, game board portion 30 is reset, with the "home team" player placing two of his playing pieces 34 on his designation 32X and four of the playing pieces 34 on the designation 32M, and with the "visiting team" player distributing two of his playing pieces 34 on the designation 32A and four of his playing pieces 34 on the designation 32L. Since both players have already lost nine of their playing pieces 34 from the playing board 30 by removing one of the playing pieces 34 from the playing board 30 after each inning, as hereinbefore described, each player has only six of the playing pieces 34 left at the beginning of extra innings. After the completion of one complete extra inning, if the game is still tied, both players will have removed one of the playing pieces 34 controlled by each player and placed it on markings 25 to reflect the completion of another inning. Thereafter, each player will have five playing pieces remaining, and play will continue on an inning by inning basis wnerein, once a player has received a third out, he can no longer receive the benefit of any offensive plays but may continue to score defensive plays against the opponent. Upon a third out, however, no further playing piece will be removed from the board. Rather, a playing piece will be removed from the player's lowest inning marking that remains covered by a playing piece in order to denote the completion of another offensive inning by such player. Play continues in such fashion until one player wins.

In addition to the procedures and rules discussed hereinbefore, special procedures and rules may be incorporated into the above described game to increase the level and degree of multiple choice strategy involved therein. For example, when a player has one of his playing pieces 34 positioned on a designation 32 that has indicia 36 disposed thereon corresponding to a stolen base, the lead baserunner of such player can be allowed to take an additional base on any hit if the playing piece on such designation has been left there from a previous turn and if the designation 32 does not have any of the opponent's playing pieces 34 positioned thereon. If more than one of a player's playing pieces 34 is so positioned to meet the above requirements, such player may apply tne extra base first to the lead runner, then to the second runner, and so on. In addition, when stealing a base, the player can be required to roll one of the dice members 38 to determine if such baserunner is safe, but the defensive play can always be scored as an out with no additional roll of the dice members 38 being required.

As aforementioned, the rules described herein may be altered to increase or decrease the level and degree of multiple choice strategy involved in the preferred embodiment of the present invention. One such alteration may involve a change in the way in which the indicia 36 associated with or disposed on the designations 32 affect the play of the first game portion 21. For example, in some instances it may be desirable to limit the affect of any particular indicia to only the offensive play marked on such designation or to only the defensive play marked on such designation. In such event, one player may initially be on defense and tne other player on offense. After three outs have been scored against the offensive player, the players may switch roles. This arrangement may thereafter be alternated for nine complete innings, similarly to what has been described above.

In addition, the combinations of offensive and defensive plays may be varied and removable indicia may be provided so that the players may vary the game each time the game is played. In this last regard, it should be noted that the removable indicia may be varied to not only vary the baseball game, but also to vary even the type of competitive sports game or simulated skill game controlled by such indicia. It will also be readily understood by those of ordinary skill in the art tnat the various simulated skill games may be varied and that the object in certain simulated skill games may be to outscore the opponent while in other simulated skill games the object may be to outdistance or score less points than the opponent, and tne game apparatus of the present invention is adaptable for use in any of these games.

Figure 14:
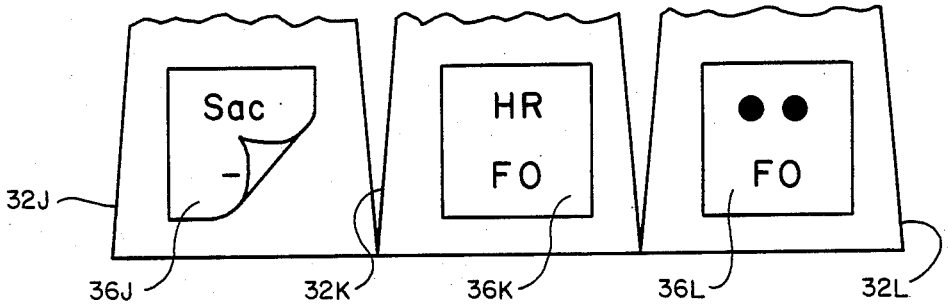
FIG. 14 is a top plan view of a portion of the multiple choice strategy game portion of a preferred embodiment that utilized removable indicia, showing one of the indicia partially removed from the game board.
Figure 15:
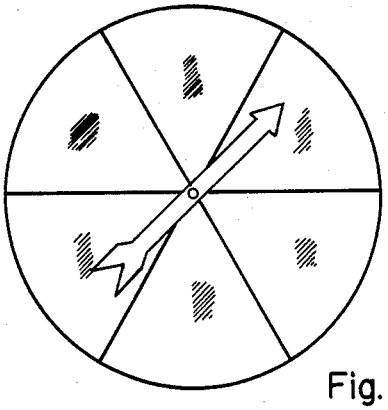
FIG. 15 is a top plan view of a spinner embodiment that may be utilized as a game motivator means.
Figure 16:
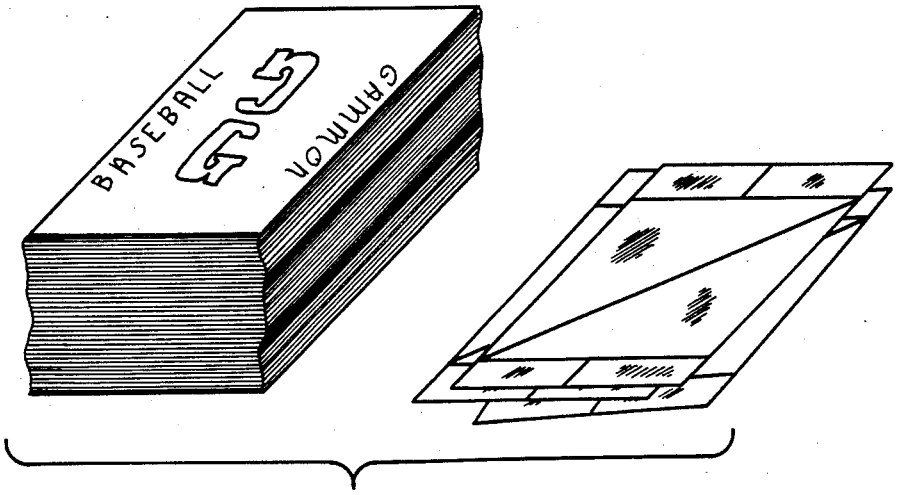
FIG. 16 is a perspective view of a deck of cards that may be utilized as game motivator means.

FIGS. 14–16 depict various of the optional features of the game that have already been discussed hereinbefore. For example, FIG. 14 shows indicia 36J partially removed from designation 32J. As has previously been noted, the use of removable indicia permits the easy alteration of the game to suit individual tastes and desires. FIG. 15 depicts a spinner, having appropriate indicia disposed at the shaded sites thereon, that may be employed as game motivator means to obtain a pair of numbers, the combination of which may be utilized in the same fashion as a number combination developed from a throw of two dice to control game play. Similarly, as depicted in FIG. 16, a deck of game cards, each of which cards includes indicia markings thereon, as denoted by the shaded sites, may be readily utilized as game motivator means. It will be readily understood that such noted optional features are but a few of the various options and additions that may be advantageously employed with or as a part of the game apparatus of the present invention.

Thus, there has been shown and described a novel game apparatus for playing a simulated skill game which apparatus includes a first game portion for displaying the progress of play of the simulated skill game and a second game portion involving multiple choice strategy, said game apparatus fulfilling all of the objectives and advantages sought therefor. It will be apparent to those skilled in the art, however, that the present game apparatus is not limited to any particular simulated skill game or any particular type of multiple choice strategy game, but can involve the combination of many different types of simulated skill games and many different types of multiple choice strategy games. All changes, modifications, variations and other uses, purposes and applications for the subject game and game apparatus which do not depart from the spirit and scope of the invention are deemed to be covered by the invention, which is limited only by the claims which follow.

What is claimed is:

1. A parlor game apparatus for playing a simulated skill game involving first and second players competing against one another in alternating turns, said game apparatus comprising a first game portion for displaying the progress of play of the simulated skill game, a second game portion, the play of which affects and determines in part the progress of play of the simulated skill game, said second game portion including first and second groups of playing pieces and a playing board portion, said first group of playing pieces controlled by the first player, said second group of playing pieces controlled by the second player, designations on said playing board portion indicating positions suitable for being occupied oy said playing pieces, indicia associated with certain ones of said designations identifying plays of the simulated skill game, and game motivator means usable by the players in alternating turns to produce movement indications, said groups of playing pieces positionable in an initial arrangement upon particular designations on said playing board portion, the positions of the first and second groups of playing pieces relative to said designations at the beginning of each player's turn in combination with the movement indication produced by each player through use of said game motivator means in his respective turn determining play options available to the player in such turn, selection of an available play option by each player in his turn determining the movement during and positioning at the conclusion of such player's turn of the playing pieces controlled by such player, the positions of said playing pieces at the conclusion of a player's turn determining tne particular indicia which affect the play of the simulated skill game in each such turn, such particular indicia in combination with the status of the simulated skill game determining the play of the simulated skill game in such turn.

2. The game apparatus of claim 1 wherein said indicia associated with certain ones of said designations are removably disposed thereon.

3. The game apparatus of claim 1 wherein said simulated skill game is a competitive sports game.

4. The game apparatus of claim 3 wherein said indicia identify at least one offensive play and at least one defensive play of said competitive sports game.

5. The game apparatus of claim 1 wherein said first game portion includes a game board portion.

6. The game apparatus of claim 5 wherein said game board portion is integrally connected to said other playing board portion.

7. The game apparatus of claim 5 wherein said game board portion includes a plurality of markings thereon representative of play features of the skill game simulated by the game apparatus.

8. The game apparatus of claim 7 wherein said first game portion includes playing pieces positionable on said markings to denote the status at any time of the the simulated skill game.

9. The game apparatus of claim 1 wherein said second game portion is a backgammon-type game.

10. The game apparatus of claim 1 wherein said game motivator means is usable to produce number combinations.

11. The game apparatus of claim 10 wherein said game motivator means are dice.

12. The game apparatus of claim 1 wherein said game motivator means includes a spinner for producing movement indications.

13. The game apparatus of claim 1 wherein said game motivator means includes cards usable to produce movement indications.

14. A board game apparatus for playing a simulated baseball game comprising a first game portion having a displaying board, markings associated with said displaying board for identifying bases, other markings associated with said displaying board for identifying innings, and still other markings associated with said displaying board for identifying outs, tokens to display the positions of baserunners relative to said bases, other tokens to move about the markings to reflect the progress of play of said simulated baseball game, and means for keeping score, and a second game portion, the play of which affects and determines in part the progress of play of the simulated baseball game, said second game portion including first and second groups of playing pieces and a playing board, said first group of playing pieces controlled by one player, said second group of playing pieces controlled by another player, designations on said playing board indicating positions suitable for being occupied by said playing pieces, indicia associated with certain ones of said designations identifying offensive and defensive plays of the simulated baseball game, and game motivator means usable by the players in alternating turns to produce movement indications, said groups of playing pieces positionable in an initial arrangement upon particular designations on said playing board, the positions of the first and second groups of playing pieces relative to said designations at the beginning of each player's turn in combination with the movement indication produced by each player through use of said game motivator means in his respective turn determining play options available to the player in such turn, selection of an available play option by each player in his turn determining the movement during and positioning at the conclusion of such player's turn of the group of playing pieces controlled by such player, the positions of said playing pieces at the conclusion of a player's turn determining the particular indicia which affect the play of the simulated baseball game in each such turn, such particular indicia in combination with the status of the simulated skill game determining the play of the simulated skill game in such turn.

15. A method of playing a simulated skill game having two competing players, comprising the steps of (a) providing a game apparatus including a first game portion having means for denoting the plays and progress of play in the simulated skill game, a second game portion including a game board portion, first and second sets of playing pieces, and game motivator means, said game board portion including a plurality of designated positions thereon upon which said playing pieces may be positioned during play of the game, at least some of said designated positions having skill play indicia associated therewith denoting plays in the simulated skill game, said game motivator means being utilizable by the players to generate movement determinants, (b) positioning said first and second sets of playing pieces upon starting positions on said game board portion, said first set of playing pieces being associated with a first one of said players and said second set of playing pieces being associated with the other of said players, (c) effecting game play, wherein each player, in alternating turn, (1) utilizes said game motivator means to generate a movement determinant, (2) elects a play from among plays available to him in light of the positions of said playing pieces relative to said designated positions at the beginning of his turn and the movement determination generated, and positions his playing pieces on said game board portion of said second game portion in accordance with the elected play, (3) receives the benefit of plays in the simulated skill game in accordance with the positions of said playing pieces at the conclusion of step (c)(2) relative to said designated positions and said skill play indicia associated therewith, and, (4) in light of the status of the simulated skill game at the beginning of the turn and the simulated skill game play benefit received during such turn, utilizes said denoting means of said first game portion to denote the further plays and the progress of play in the simulated skill game.

* * * * *

UNITED STATES PATENT OFFICE

CERTIFICATE OF CORRECTION

Patent No. 4,657,254 Dated April 14, 1987

Inventor(s) David B. Renner

It is certified that error appears in the above-identified patent and that said Letters Patent are hereby corrected as shown below:

Column 1, line 14, "tne" should be --the--.
Column 2, line 26, "tne" should be --the--.
Column 2, line 28, "tne" should be --the--.
Column 2, line 34, "witn" should be --with--.
Column 2, line 58, "whicn" should be --which--.
Column 3, line 13, "emoodiment" should be --embodiment--.
Column 3, line 13, "snowing" should be --showing--.
Column 3, line 14, "tne" should be --the--.
Column 3, line 16, "tne" should be --the--.
Column 3, line 48, "tne" should be --the--.
Column 3, line 49, "Tne" should be --The--.
Column 5, line 13, "tnereon" should be --thereon--.
Column 5, line 29, "Tne" should be --The--.
Column 5, line 47, "Tne" should be --The--.
Column 5, line 53, "32-32F" should be --32A-32F--.
Column 5, line 54, "tne" should be --the--.
Column 6, line 22, "tnerefore" should be --therefore--.
Column 6, line 60, "tne" should be --the--.
Column 7, line 40, "tne" should be --the--.
Column 7, line 64, "whetner" should be --whether--.
Column 10, line 5, "tnere" should be --there--.
Column 10, line 36, "tnereon" should be --thereon--.
Column 10, line 37, "nas" should be --has--.
Column 11, line 49, "tne" should be --the--.

UNITED STATES PATENT OFFICE

CERTIFICATE OF CORRECTION

Patent No. 4,657,254 Dated April 14, 1987

Inventor(s) David B. Renner

It is certified that error appears in the above-identified patent and that said Letters Patent are hereby corrected as shown below:

Column 11, line 67, "tne" should be --the--.
Column 12, line 13, "tnat" should be --that--.
Column 12, line 18, "tne" should be --the--.
Column 13, line 5, "oy" should be --by--.
Column 13, line 22, "tne" should be --the--.

Signed and Sealed this

Eleventh Day of August, 1987

*Attest:*

DONALD J. QUIGG

*Attesting Officer*

*Commissioner of Patents and Trademarks*